US011545098B2

(12) United States Patent
Wang et al.

(10) Patent No.: US 11,545,098 B2
(45) Date of Patent: Jan. 3, 2023

(54) DRIVING APPARATUS FOR DISPLAY PANEL HAVING SELECTION CIRCUIT FOR OUTPUTTING A PLURALITY OF DRIVING VOLTAGES

(71) Applicant: Egis Technology Inc., Hsinchu (TW)

(72) Inventors: Chung-Yi Wang, Hsinchu (TW); Yu-Hsuan Lin, Hsinchu (TW)

(73) Assignee: Egis Technology Inc., Hsinchu (TW)

( * ) Notice: Subject to any disclaimer, the term of this patent is extended or adjusted under 35 U.S.C. 154(b) by 0 days.

(21) Appl. No.: 17/601,440

(22) PCT Filed: Mar. 6, 2020

(86) PCT No.: PCT/CN2020/078091

§ 371 (c)(1),
(2) Date: Oct. 5, 2021

(87) PCT Pub. No.: WO2020/224318

PCT Pub. Date: Nov. 12, 2020

(65) Prior Publication Data

US 2022/0165226 A1 May 26, 2022

Related U.S. Application Data

(60) Provisional application No. 62/850,562, filed on May 21, 2019, provisional application No. 62/842,536, filed on May 3, 2019.

(51) Int. Cl.
*G09G 3/36* (2006.01)

(52) U.S. Cl.
CPC ..... *G09G 3/36* (2013.01); *G09G 2310/0297* (2013.01)

(58) Field of Classification Search
CPC ..... G09G 3/36
USPC ..... 345/214
See application file for complete search history.

(56) References Cited

U.S. PATENT DOCUMENTS 5,670,973 A * 9/1997 Bassetti, Jr ..... G09G 3/3685 345/100
9,773,450 B2 9/2017 Takahara
2014/0036216 A1 2/2014 Goto et al.
(Continued)

FOREIGN PATENT DOCUMENTS

CN 1499474 5/2004
CN 1804708 7/2006
CN 103915416 7/2014
(Continued)

OTHER PUBLICATIONS

"International Search Report (Form PCT/ISA/210) of PCT/CN2020/078091", dated May 27, 2020, with English translation thereof, pp. 1-4.
(Continued)

*Primary Examiner* — Long D Pham
(74) *Attorney, Agent, or Firm* — JCIPRNET

(57) ABSTRACT

A driving apparatus for a display panel is provided. The driving apparatus for the display panel is configured on a film by means of a Chip-on-Film (COF) package. A selection circuit receives multiple driving voltages. A control circuit is coupled to the selection circuit and controls the selection circuit to output one of the multiple driving voltages, so as to drive the display panel.

6 Claims, 5 Drawing Sheets

(56) References Cited

U.S. PATENT DOCUMENTS

| | | | | |
|---|---|---|---|---|
| 2017/0076694 | A1 | 3/2017 | Shin et al. | |
| 2018/0307357 | A1* | 10/2018 | Lee | G06F 3/0412 |

FOREIGN PATENT DOCUMENTS

| | | |
|---|---|---|
| CN | 104038206 | 9/2014 |
| CN | 104332147 | 2/2015 |
| CN | 103903557 | 8/2016 |
| CN | 106023928 | 10/2016 |
| CN | 107103889 | 8/2017 |
| CN | 109166552 | 1/2019 |
| CN | 109697962 | 4/2019 |
| CN | 211376151 | 8/2020 |
| TW | I569080 | 2/2017 |
| WO | 2016074297 | 5/2016 |

OTHER PUBLICATIONS

"Office Action of China Counterpart Application", dated Nov. 2, 2022, p. 1-p. 8.

* cited by examiner

DRIVING APPARATUS FOR DISPLAY PANEL HAVING SELECTION CIRCUIT FOR OUTPUTTING A PLURALITY OF DRIVING VOLTAGES

CROSS-REFERENCE TO RELATED APPLICATION

This application is a 371 application of the international PCT application serial no. PCT/CN2020/078091, filed on Mar. 6, 2020, which claims the priority benefit of U.S. application No. 62/842,536, filed on May 3, 2019 and U.S. application No. 62/850,562, filed on May 21, 2019. The entirety of each of the above-mentioned patent applications is hereby incorporated by reference herein and made a part of this specification.

BACKGROUND

Technical Field

This disclosure relates to a driving apparatus, and in particular to a driving apparatus for a display panel.

Description of Related Art

In general, a Tape Carrier Package (TCP), a Chip-on-Glass (COG) package and a Chip-on-Film (COF) package substrate may be used for semiconductor packaging of a driven LCD panel. Taking the COF means as an example, since it is not easy to perform perforation winding wiring on the COF package substrate, it is necessary to respectively dispose traces on the COF package substrate corresponding to different control signals. For example, FIG. 1 is a schematic diagram of a related art display panel and a COF package substrate. As shown in FIG. 1, a control chip IC1 may provide multiple control voltages V1 to V4 to a display panel DP1. A trace layout on a film F1 may be relatively simple when signal types of the control voltages V1 to V4 are the same (for example, a high voltage level and a low voltage level are the same), thus, traces on the film F1 do not have to cross over each other.

However, when the signal types of the control voltages V1 to V4 are different, for example, when the high voltage level and the low voltage level of each of the control voltages V1 to V4 are not exactly the same as the other control voltages, means of designing the trace layout is limited, and a probability of the traces on the film F1 having to cross over each other increases. Since the film F1 is unable to dispose a jumper wire due to limitation by its single-layer trace, the trace layout has to be extended onto a printed circuit board PB1 and the issue of the traces crossing over each other is overcome through using a jumper wire W1 to connect contact points C1 and C2, as shown in FIG. 2. However, such a design elongates the traces, which in turn not only increases the manufacturing cost, but also increases the risk of interference of the control signal.

SUMMARY

This disclosure provides a driving apparatus for a display panel, which can effectively prevent having to design a trace layout of a Chip-on-Film (COF) package substrate through addition of a jumper wire.

The driving apparatus for the display panel of the disclosure is configured on a film by means of a COF package, and the driving apparatus for the display panel includes at least one selection circuit and a control circuit. The selection circuits respectively receive multiple driving voltages. The control circuit is coupled to the selection circuits, and controls each of the selection circuits to output one of the multiple driving voltages, so as to drive the display panel.

Based on the above, the selection circuits of the embodiment of the disclosure may receive the multiple driving voltages, and be controlled by the control circuit to output one of the multiple driving voltages, so as to drive the display panel. This enables the traces on the COF package substrate to transmit the driving voltages with the different voltage levels, without having to provide the driving voltages with the different voltage levels through addition of a jumper wire.

To make the abovementioned more comprehensible, several embodiments accompanied by drawings are described in detail as follows.

DESCRIPTION OF THE EMBODIMENTS

Figure 1:
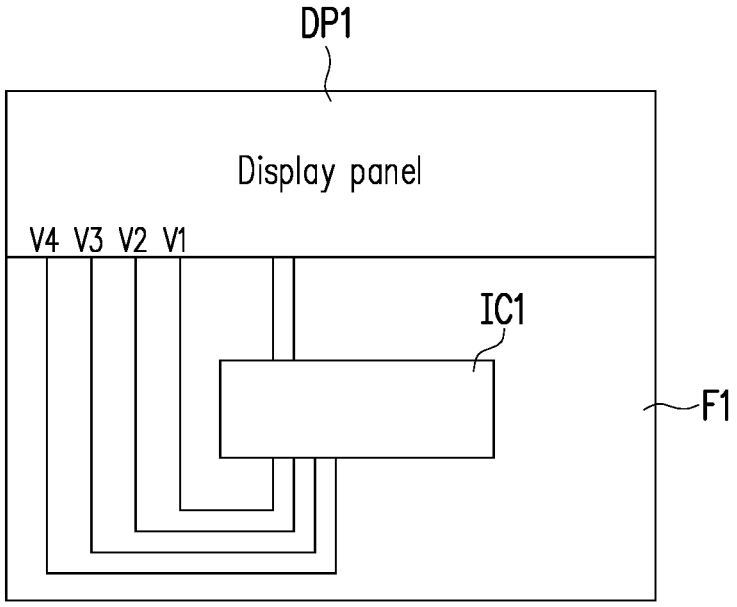
FIG. 1 is a schematic diagram of a display panel and a Chip-on-Film (COF) package substrate of the related art.
Figure 2:
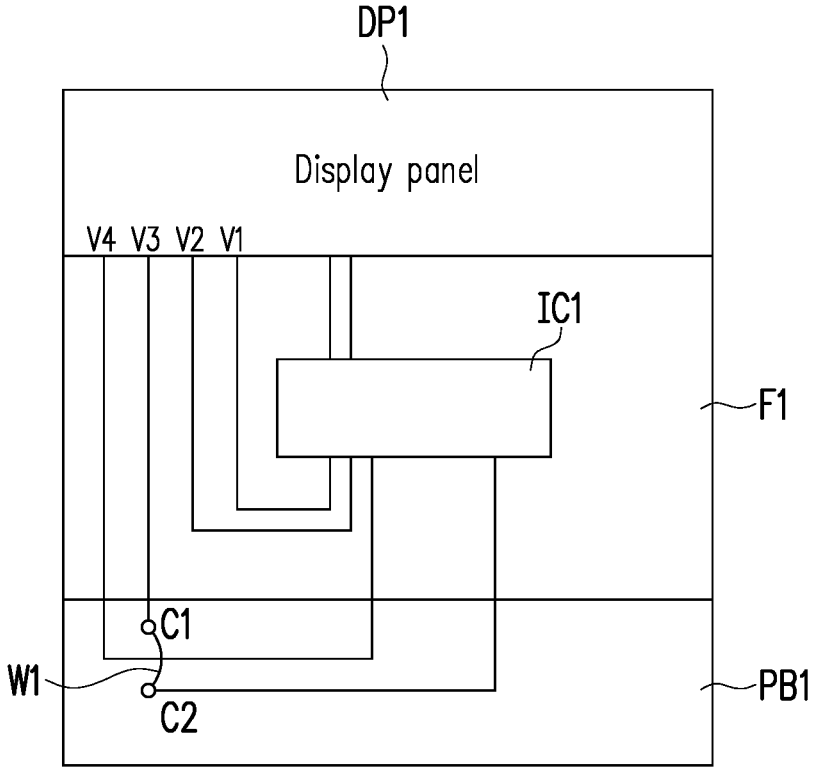
FIG. 2 is a schematic diagram of a display panel, a Chip-on-Film (COF) package substrate, and a printed circuit board of the related art.
Figure 3:
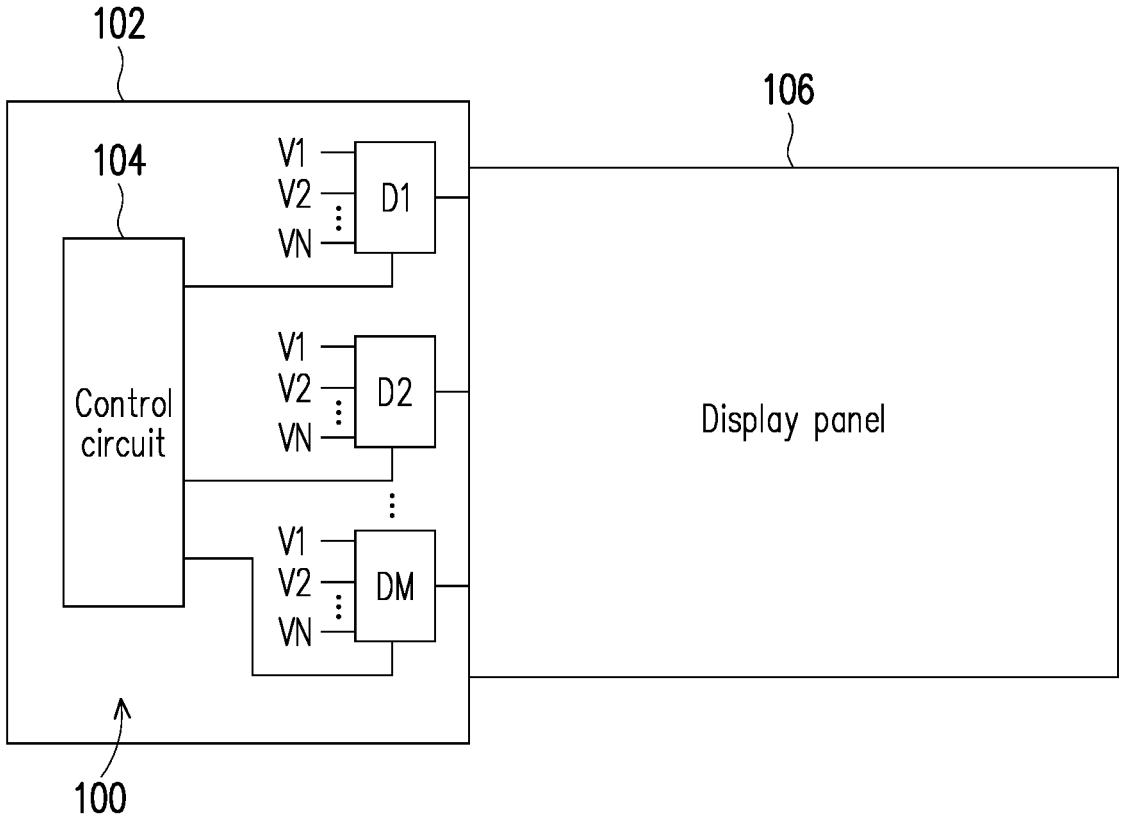
FIG. 3 is a schematic diagram of a driving apparatus for a display panel according to an embodiment of the disclosure.

FIG. 3 is a schematic diagram of a driving apparatus for a display panel according to an embodiment of the disclosure. With reference to FIG. 3, a driving apparatus 100 for a display panel is configured on a film 102 by means of a Chip-on-Film (COF) package. The driving apparatus 100 for the display panel includes selection circuits D1 to DM and a control circuit 104, where M is a positive integer. The control circuit 104 is coupled to the selection circuits D1 to DM, and the selection circuits D1 to DM are coupled to the display panel 106 through COF conducting wires on the film 102.

Each of the selection circuits D1 to DM may receive multiple driving voltages V1 to VN, where N is a positive integer, and each of the driving voltages V1 to VN may have a different voltage value. The control circuit 104 may respectively control each of the selection circuits D1 to DM to output one of the driving voltages V1 to VN to a corresponding COF conducting wire, so as to drive the display panel 106 to display an image screen. The selection circuits D1 to DM may be, for example, gate driving circuits, in which the driving voltages outputted by the selection circuits are configured to drive corresponding gate scan lines.

As the control circuit 104 controls the selection circuits D1 to DM to output one of multiple driving voltages to drive the display panel 106, this enables the COF conducting wires on the COF package substrate to transmit the driving voltages with different voltage levels, without having to provide the driving voltages with the different voltage levels through addition of a jumper wire. Therefore, the manufacturing cost can be effectively reduced, and noise interference in the driving voltages due to the traces being excessively long can be prevented, thereby preventing affecting display quality of the display panel 106.

Figure 4:
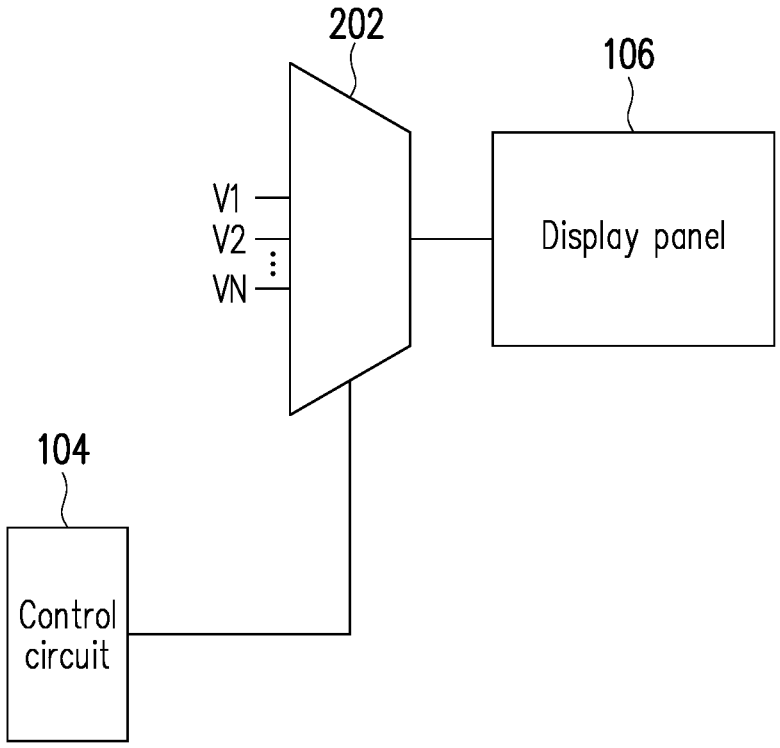
FIG. 4 is a schematic diagram of a driving apparatus for a display panel according to another embodiment of the disclosure.

FIG. 4 is a schematic diagram of a driving apparatus for a display panel according to another embodiment of the disclosure. With reference to FIG. 4, a difference between the embodiments in FIGS. 3 and 4 is that, in this embodiment, each of the selection circuits D1 to DM is implemented as a multiplexer. To keep the diagram concise, only one multiplexer 202 is shown and the film 102 is omitted in FIG. 4. However, the number of multiplexers (that is, the number of the selection circuits) is not limited thereto. As shown in FIG. 4, an input terminal of the multiplexer 202 may receive the multiple driving voltages V1 to VN, a control terminal of the multiplexer 202 is coupled to the control circuit 104, and an output terminal of the multiplexer 202 is coupled to the display panel 106 through the corresponding COF conducting wire. The control circuit 104 may control the multiplexer 202 to output one of the driving voltages V1 to VN to the display panel 106, so as to drive the display panel 106 to display an image screen.

Figure 5:
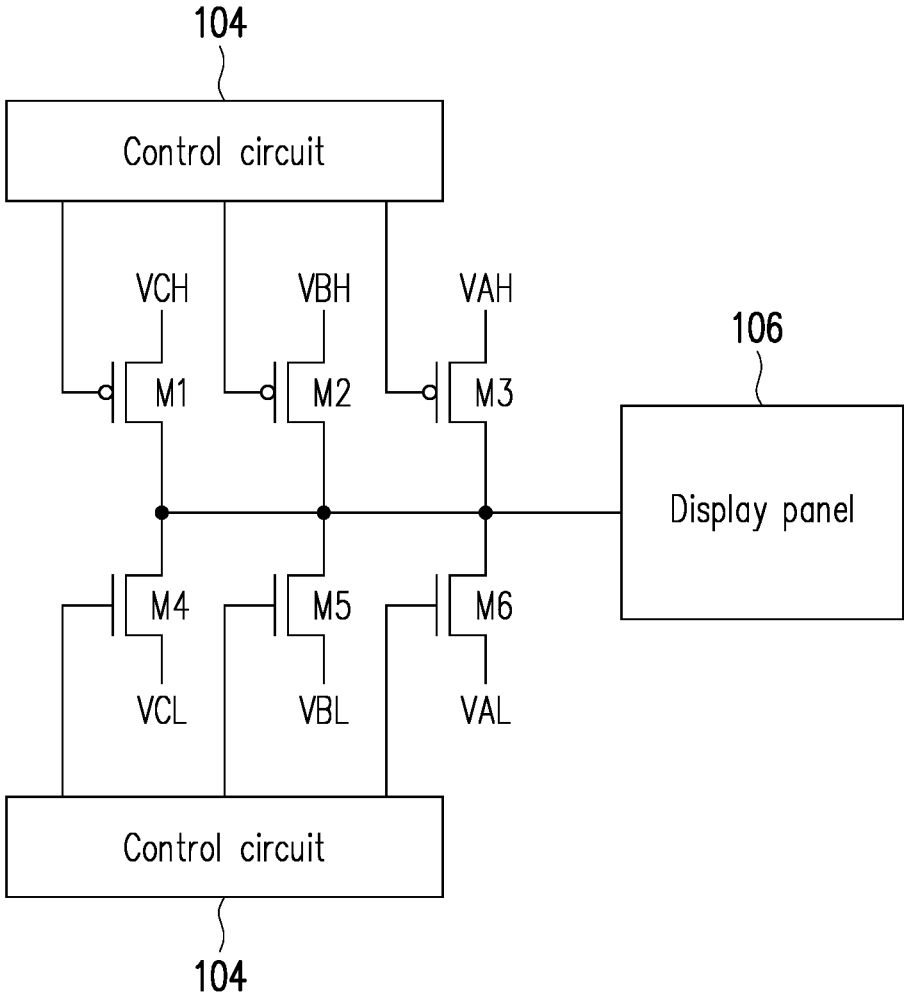
FIG. 5 is a schematic diagram of a driving apparatus for a display panel according to another embodiment of the disclosure.

FIG. 5 is a schematic diagram of a driving apparatus for a display panel according to another embodiment of the disclosure. With reference to FIG. 5, a difference between the embodiments in FIGS. 3 and 5 is that, in this embodiment, each of the selection circuits D1 to DM may include multiple switches (to keep the diagram concise, only implementation architecture of a selection circuit is shown and the film 102 is omitted in FIG. 5). Each of the switches may be implemented by transistors M1 to M6, but is not limited thereto. Gates of transistors M1 to M6 are coupled to the control circuit 104, the transistors M1 and M4 are connected in series between a voltage VCH and a voltage VCL, the transistors M2 and M5 are connected in series between a voltage VBH and a voltage VBL, and the transistors M3 and M6 are connected in series between a voltage VAH and a voltage VAL. In addition, a common contact point of the transistors M1 and M4, a common contact point of the transistors M2 and M5, and a common contact point of the transistors M3 and M6 are connected to the display panel 106 through a same COF conducting wire. The control circuit 104 may control a turned-on state of the transistors M1 to M6, and select one of the voltages VAH, VAL, VBH, VBL, VCH, and VCL to be outputted to the display panel 106, so as to drive the display panel 106 to display an image screen.

It should be noted that, in other embodiments, the number of transistors included in the selection circuits is not limited by this embodiment. The number of transistors included in the selection circuits may be greater according to actual application, therefore the selection circuits may provide a greater variety of driving voltages to drive the display panel.

In summary, the selection circuits according to the embodiments of the disclosure may receive the multiple driving voltages, and be controlled by the control circuit to output one of multiple driving voltages, so as to drive the display panel. This enables the traces on the COF package substrate to transmit the driving voltages with the different voltage levels without having to provide the driving voltages with the different voltage levels through addition of a jumper wire. Therefore, the manufacturing cost can be effectively reduced, and noise interference in the driving voltages due to the traces being excessively long can be prevented, thereby preventing affecting display quality of the display panel 106.

What is claimed is:

1. A driving apparatus for a display panel, configured on a film by means of a Chip-on-Film (COF) package, comprising:

at least one selection circuit, configured to respectively receive a plurality of driving voltages; and a control circuit, coupled to the at least one selection circuit, and configured to control each of the selection circuits to output one of the plurality of driving voltages, so as to drive the display panel, wherein each of the plurality of selection circuits is a gate driving circuit that outputs one of the plurality of driving voltages, so as to drive a corresponding gate scan line.

2. The driving apparatus for the display panel according to claim 1, wherein each of the selection circuits comprises:

a multiplexer, wherein an input terminal of the multiplexer receives the plurality of driving voltages and the multiplexer is controlled by the control circuit to select one of the plurality of driving voltages to output to the display panel.

3. The driving apparatus for the display panel according to claim 1, wherein each of the selection circuits comprises:

a plurality of switches, wherein a terminal of each of the plurality of switches is coupled to an output terminal of the plurality of selection circuits, and another terminal is coupled to a corresponding driving voltage, wherein the control circuit controls a turned-on state of the plurality of switches through a control terminal of each of the plurality of switches, so as to output one of the plurality of driving voltages to drive the display panel.

4. The driving apparatus for the display panel according to claim 1, wherein each of the plurality of switches is a transistor.

5. The driving apparatus for the display panel according to claim 1, wherein the plurality of driving voltages have different voltage values.

6. The driving apparatus for the display panel according to claim 1, wherein each of the plurality of selection circuits is controlled by the control circuit to output one of the plurality of driving voltages to a corresponding COF conducting wire, and is coupled to and drive the display panel through the COF conducting wire.

* * * * *